US005772483A

United States Patent [19]

Vielmo et al.

[11] Patent Number: 5,772,483

[45] Date of Patent: Jun. 30, 1998

[54] MONO-MOORING METHOD AND SYSTEM FOR BERTHING SHIPS IN OPEN SEA

[75] Inventors: Paolo Vielmo, Venice; Vincenzo Di Tella, Padua, both of Italy

[73] Assignee: Tecnomare S.p.A., Venice, Italy

[21] Appl. No.: 815,579

[22] Filed: Mar. 12, 1997

[30] Foreign Application Priority Data

Mar. 21, 1996 [IT] Italy ..... MI96A0555

[51] Int. Cl.[6] ..... B63B 22/02

[52] U.S. Cl. ..... 441/5; 114/230

[58] Field of Search ..... 114/230; 441/35

[56] References Cited

U.S. PATENT DOCUMENTS 3,942,204 3/1976 Gruy ..... 441/5
4,299,262 11/1981 Andrepont ..... 441/5
4,372,344 2/1983 Stafford ..... 441/5
4,480,575 11/1984 Delamare .

FOREIGN PATENT DOCUMENTS 2 056 391 3/1981 United Kingdom .
2 273 087 6/1994 United Kingdom .

*Primary Examiner*—Stephen Avila
*Attorney, Agent, or Firm*—Oblon, Spivak, McClelland, Maier & Neustadt, P.C.

[57] ABSTRACT

A single point mooring method, wherein a fixed structure is anchored to sea bed. A first member is connected to the fixed structure rotatably around a first axis and a second member is connected to the first member rotatably around a second axis perpendicular to the first axis. The tanker mooring line is connected to the second member rotatably, and a flexible pipeline for transferring fluid to or from the tanker is rotatably connected to the second member so as to compensate stress in the tanker mooring line caused by translational and rotational movements of the tanker.

5 Claims, 4 Drawing Sheets

MONO-MOORING METHOD AND SYSTEM FOR BERTHING SHIPS IN OPEN SEA

BACKGROUND OF THE INVENTION

1. Field of the Invention

This invention relates to a single-point mono-mooring method for ships, preferably tankers, and a structure for implementing the method. More particularly, said structure comprises in advantageous cooperation a toroid-formed device, a fork element and a rotatable sleeve.

2. Discussion of the Background

That method mooring tankers in open sea which best satisfies ship safety and operating requirements, in that with the advent of giant tankers it becomes increasingly more difficult to find ports of sufficient depth to enable such tankers to be moored, is to moor these tankers on buoys to enable the fluid to be loaded and unloaded. Moreover, moorings in open sea are often advantageous, if not indeed essential, when drawing fluid fuel extracted from deposits located in the sea bed. In this respect, it should be noted that in the description and claims, the term "fluid" is meant to include gas, liquids and their mixtures. In loading and unloading fluids between tankers and dry land, so-called mono-mooring has been known for some time, this as the name suggests using a single mooring and in particular a floating buoy to which the tanker is moored and an adequate pipeline is secured for transferring the fluid from the tanker to land storage and vice versa.

The basic operational aspect of mono-mooring is to enable the operations involved in transfer to be performed even under adverse atmospheric conditions, when the tanker, urged by wind and currents, positions itself in the natural direction, which can continuously change as the environmental conditions vary. In this case, although the tanker remains moored, it in fact moves by rotating about the mono-mooring, while maintaining the same orientation to this latter. The operating structure for mono-mooring is therefore required to satisfy two basic functions, the first involving the anchoring cable or chain, ie coupling to the tanker a cable anchored to the sea bed and consequently reacting to the pull on the tanker, the second involving fluid transfer between the pipelines originating from the tanker or arriving at the tanker and the pipelines connected to land storage. As the tanker is mobile while the connections to land are fixed, it is evident that this second function requested of the mono-mooring is the more severe, in that the flexible pipeline extending from the tanker to the buoy structure anchored to the sea bed, and which carries the liquid feed, may be subject to rapid wear not only because of the continuous stresses caused by the movement of the sea but also because by the action of the sea it often comes into contact with the mooring chain. Moreover, in many cases, this flexible pipeline twists about the buoy structure anchored to the sea bed, putting the loading and unloading station out of action for a considerable time. In this respect, it is evident that even under the worst operating conditions the anchorage must provide maximum guarantees and maximum possible safety, because the sudden yielding of a buoy while the tanker is loading or unloading can cause damage of unimaginable gravity. Again, it is apparent that the provision of a safe mooring system means the availability of a loading and unloading station which will be much used, and hence resulting in practice in considerable economical advantages. Various mooring buoys have been developed in the past, but these have been invariably complicated overall, and hence of costly construction. Moreover, such buoys do not allow the tanker sufficient movement, nor enable the mooring forces to be satisfactorily absorbed.

SUMMARY OF THE INVENTION

An object of the present invention is therefore to provide a mooring buoy which is sufficiently easy to handle, and which can be constructed effectively and at low cost. A further object of the present invention is to provide a structure suitable for berthing in open sea, such as to enable the berthed tanker to assume at any moment the most convenient direction on the basis of the dominant wind and the sea conditions, so that the tanker can move in a complete circle, thus enabling it to always remain with its bow into the blowing wind. A further object of the present invention is to provide structural elements which support the mooring forces within a unified structure which enables the tanker to move without imposing mooring stresses on the structure, on the flexible pipeline or on the tanker. A further object of the present invention is to provide structural berthing elements which are particularly simple and hence relatively economical. These and further considerable advantages, particularly with regard to practicality, operating safety, the practical elimination of determined breakage and damage risks, and simplification of the operations involved in berthing the tanker, are attained by the single-point mooring method of the present invention, in which there are provided a fixed structure anchored to the sea bed, a mooring chain or cable and at least one flexible pipeline, said mooring method comprising compensating the translational and rotational movements of the tanker by rotations of elements advantageously connected together, wherein the axes of rotation of said elements intersect substantially at a point lying on the axis of symmetry of a toroidal device, this latter being supported by and joined to the fixed structure anchored rigidly to the sea bed. In its practical implementation, the single-point mooring method of the present invention is characterised in that the rotations of the mutually connected structural elements originate overall a substantially spherical angular oscillation, said rotations occurring totally or partially superposed in time, or in continuous or discontinuous time sequence. The single-point mooring method of the present invention is also characterised in that the flexible pipeline for fluid transfer is rendered torsionally free within that portion in which it is coupled to the mutually connected and rotating elements joined to the toroidal device. The structure used for the practical implementation of the method of the present invention comprises:

- a toroid-formed device supported by and connected to an axial or radial thrust bearing, which is connected to the fixed base structure such as to allow relative rotation between said underlying fixed structure and said overlying toroidal device about a substantially vertical axis;
- a fork element with bifurcation at one end for its movement as an oscillating rod about a substantially horizontal axis, and with sized holes close to its ends as seats for pins, which operate rotatably to the mobile connections, at one end with the toroidal device and at the other end with the mooring chain and jointly with a sleeve supporting a portion of flexible pipeline for transferring the fluid;
- a rotatable sleeve hinged to the fork and operating on a bearing arrangement of rolling-contact friction elements, or of grazing-contact friction elements, for rotatably supporting the flexible pipeline.

The invention is described in detail hereinafter on the basis of the embodiment represented schematically on the drawings of the accompanying figures, together with the clarification of further details and characteristics, in which respect it should be noted that any variations in the relative positions of the elements and the consequent simplifications which may derive therefrom are to be considered as falling within the requested protection as constructional modifications included in the general idea.

On the accompanying drawings:

DESCRIPTION OF THE PREFERRED EMBODIMENTS

Figure 1:
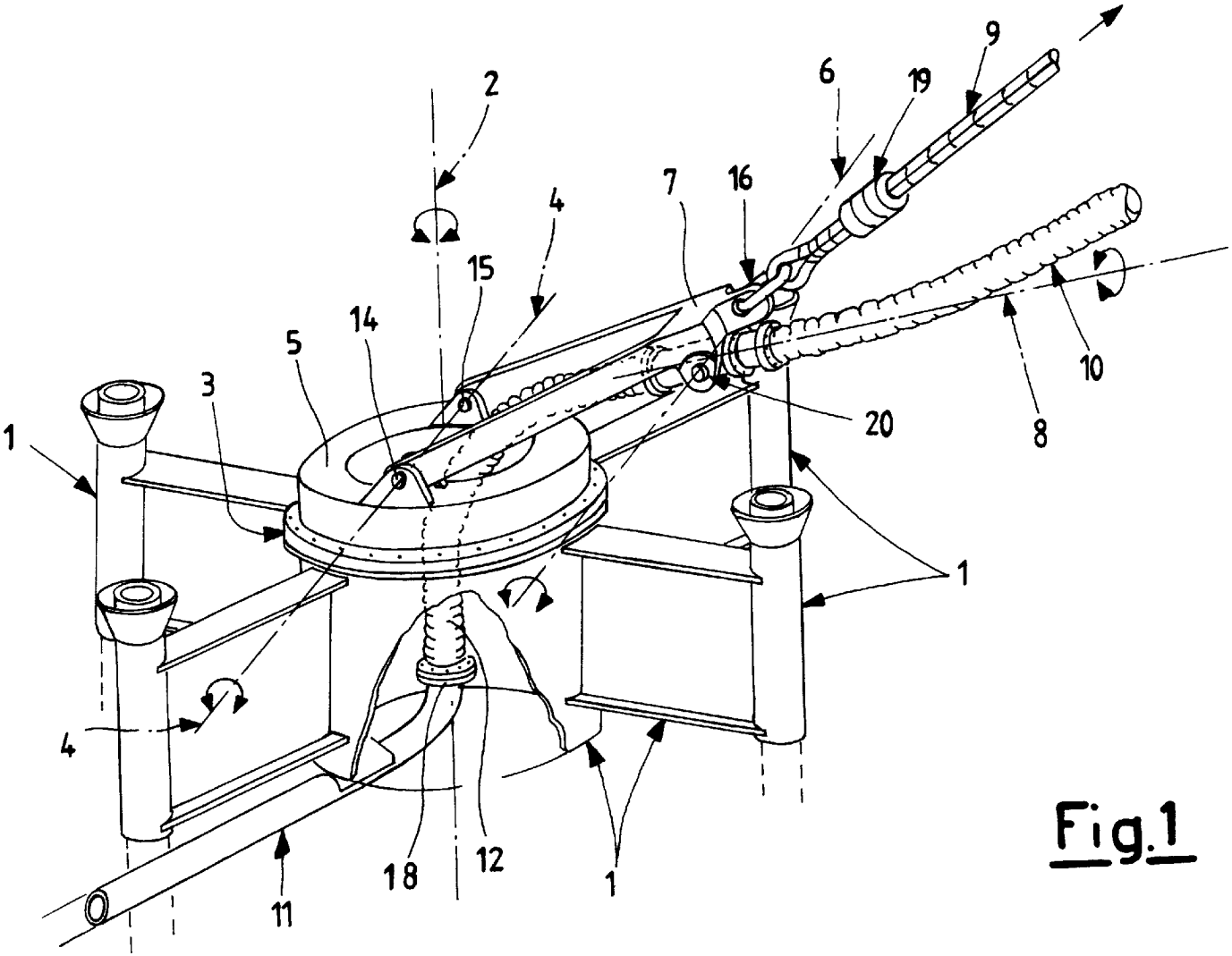
FIG. 1 is a perspective view of the structure of the present invention showing the base framework surmounted by the superposed structural elements, with a thrust bearing, a toroidal device, a fork element and a rotatable sleeve, and further schematically showing the flexible pipeline, the rigid base pipeline and the mooring chain.
Figure 2:
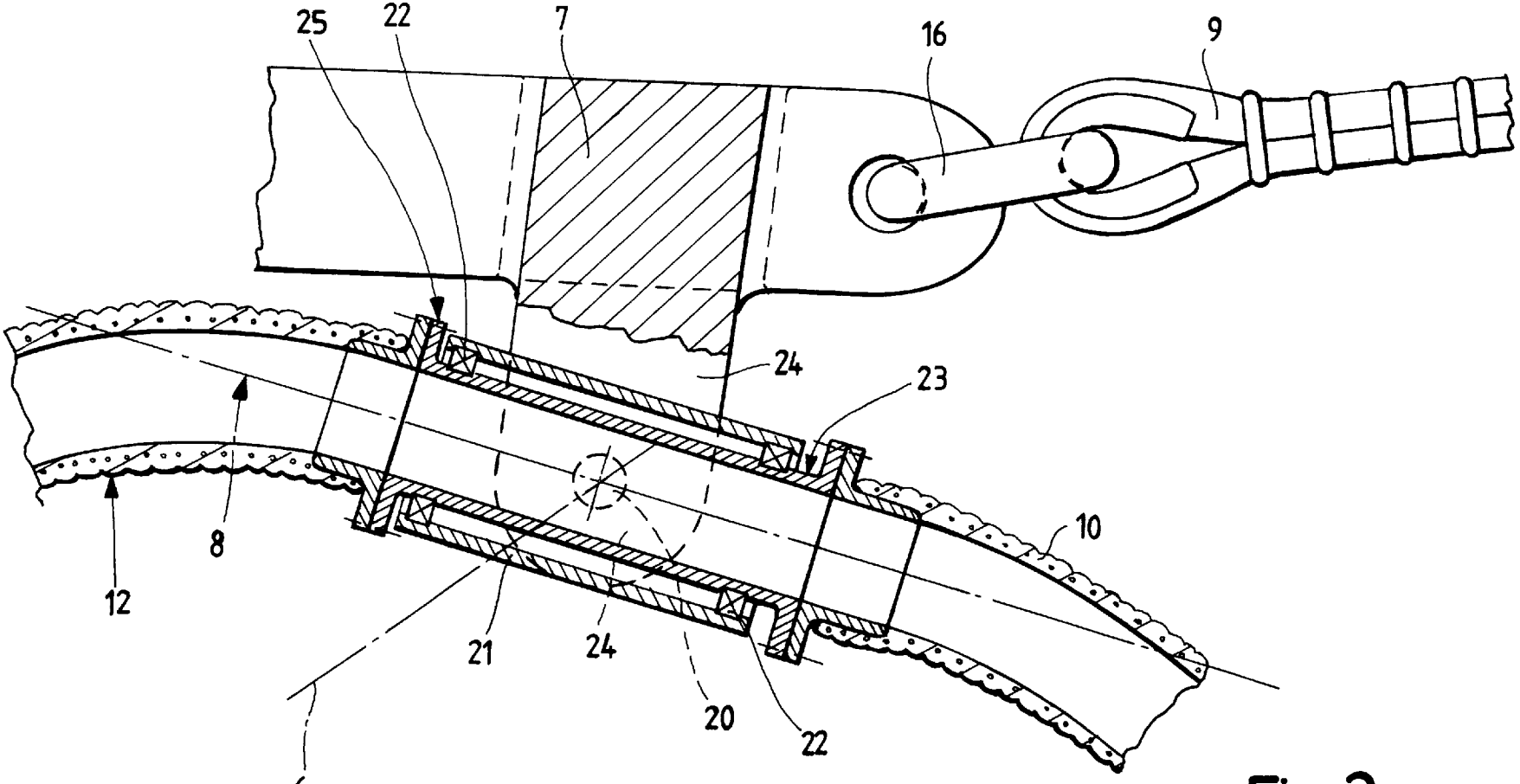
FIG. 2 is a partly sectional schematic front view of the rotatable sleeve hinged to the fork and operating on a bearing arrangement for the rotatable support of the flexible pipeline.

In the figures of the accompanying drawings, equal elements or those with identical functions carry the same reference characters for simplicity.

With reference to the figures, the tanker mooring and fluid transfer structure of the present invention is shown resting on the sea bed. Although the structure of the present invention is described herein as located on the sea bed, it is equally of use in other waters. The structure consists essentially of a large solid fixed platform indicated overall by 1, constructed on piles driven into the sea bed and depending on the depth of the sea bed can be partly or totally encased. Other types of fixing can be used. Said fixed platform 1 centrally supports the thrust bearing 3, which as an axial and radial or combined thrust bearing operates in a substantially horizontal position. The thrust bearing 3 supports and is suitably connected to a toroid-formed device 5, which can rotate on said platform 1 about a substantially vertical geometrical axis 2. The toroidal device 5 of FIG. 1 comprises two diametrically opposite flat elements rigidly fixed as one piece on its upper surface. Said flat elements are of a suitable shape for housing the pins 14 and 15, which form a rotatable connection with the two ends of the fork 7 via suitably sized holes. The fork element 7 is hence free to rotatably oscillate about a substantially horizontal axis 4. The opposite end of the fork 7 is of a shape suitable for its anchoring to the mooring chain 9, which along its length comprises frequent spaced-apart floats 19 for supporting suspended in the water the mooring chain 9, which retains the tanker in position for the entire time required for transferring the fluid. In the preferred connection method of FIG. 1, the ring 16 is the joining element between the mooring chain 9 and the fork 7.

Figure 3:
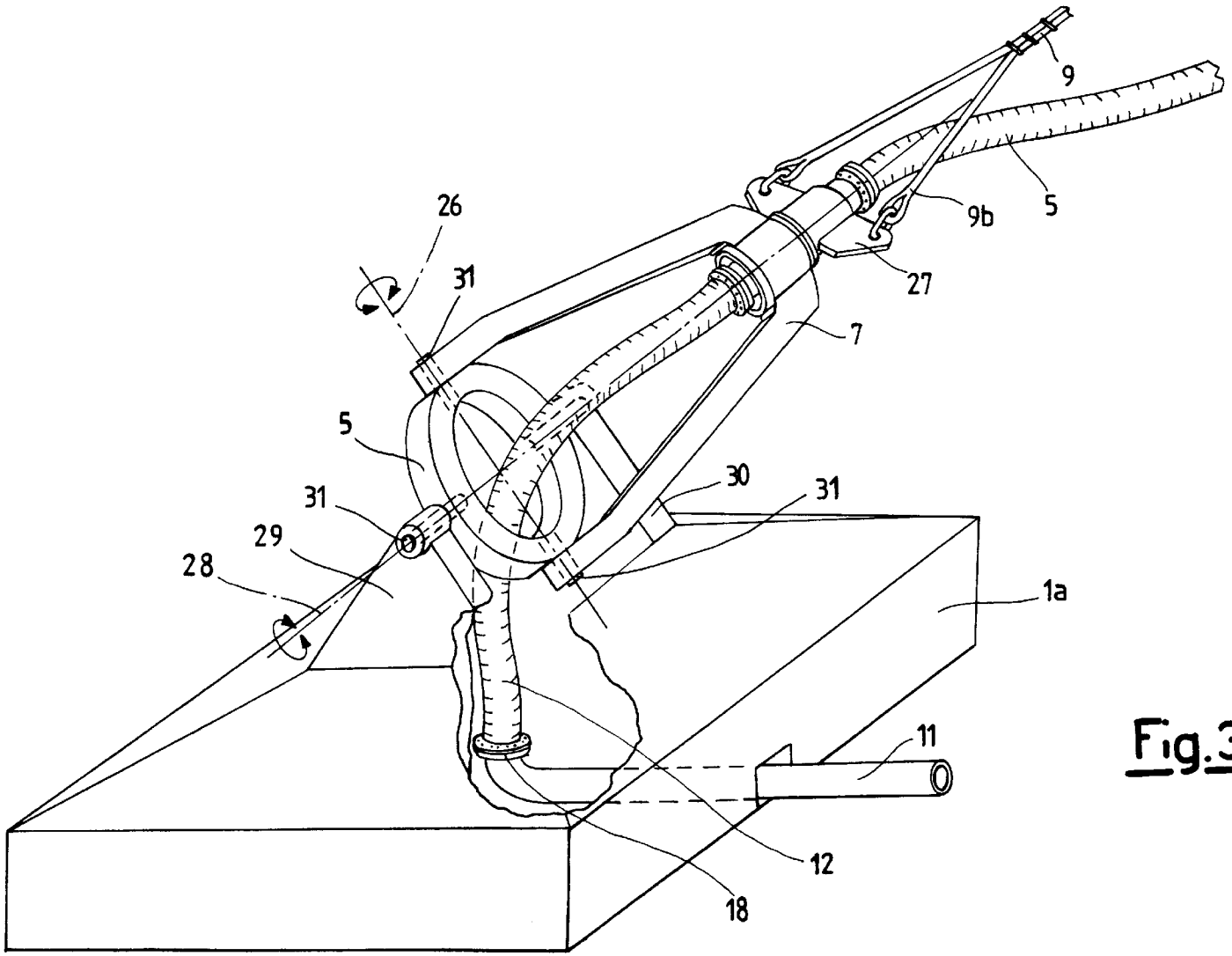
FIG. 3 is a schematic view of one embodiment which includes the presence of an articulated joint of universal or cross type or a similar coupling element enabling the structural elements to move along a substantially spherical surface.
Figure 4:
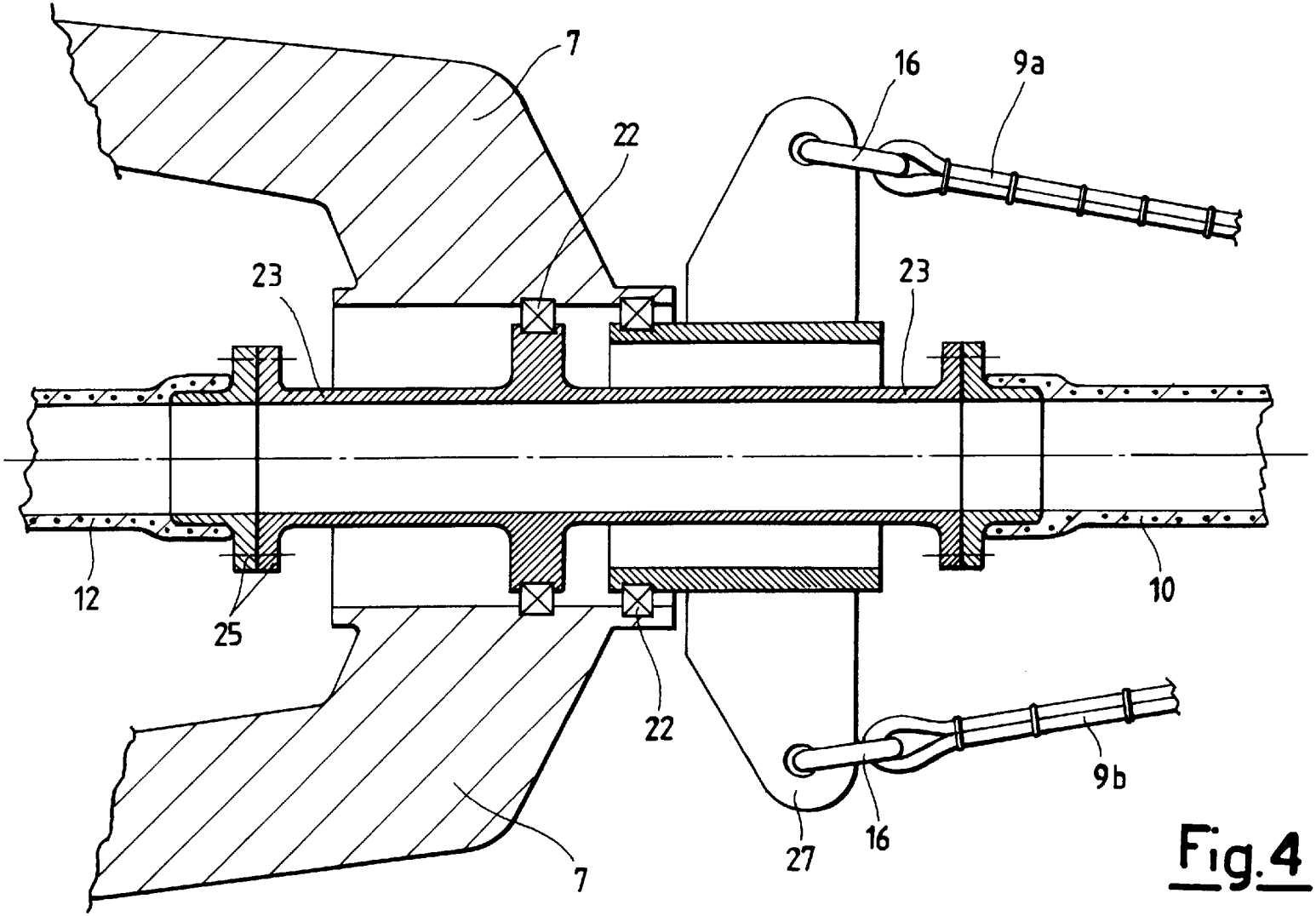
FIG. 4 is a partly sectional schematic front view of the rotatable sleeve, which can be connected to the mooring chain 9 and to the fork 7 via a bearing arrangement 22 for the rotatable support of the flexible pipeline conveying the fluid.

Advantageously, at the end connected to the chain 9 the fork element 7 is formed with two flat expansions 24 embracing a rotatable sleeve 21 which by means of a bearing arrangement 22 supports freely rotatable a rigid pipeline portion 23. By means of flat flanges 25, said rigid portion 23 is flanged at its ends to the flexible pipelines 10 and 12. The flanged joints must provide a perfect seal for the fluid transferred under pressure. The flat expansions 24 are joined by a rotatable articulation system formed form pins 20 inserted advantageously between said flat expansions 24 and the rotatable sleeve 21. Said articulated joint allows free angular oscillation between the fork 7 and the flexible fluid transfer pipeline about the axis of rotation 6, with the precise and innovative result of eliminating practically any flexural and/or flexo-torsional stress on the flexible pipeline, especially in that portion thereof passing freely through the central space of the elements which essentially form the structure of the present invention. The bearing arrangement 22 of the rotatable sleeve 21 allows free angular positioning of the flexible pipeline along its longitudinal axis 8 for the variable angular positions of the fork 7, which oscillates variably on the basis of the pulling direction of the mooring chain 9. A feed line 11 is positioned on the sea bed and has an end sealedly connected to the flexible pipeline 12 by a flange 18. At its other end, not shown, the feed line leads to a storage accessory, also not shown but habitually located on the near shore. This storage accessory can also be located out at sea, for example close to a well located offshore. According to a further preferred embodiment shown in FIGS. 3 and 4, the structure 1*a* lies stably on the sea bed, preferably by gravity. Two flat supports 29, 30 are advantageously positioned on and fixed to the structure 1*a* to retain pins 31 coupled, freely rotatable about the axis 28, to the toroidal device 5. This latter device 5 is also connected to the ends of the fork 7 by pins 31, which provide a coupling with rotational freedom about the axis 26. The perpendicular rotations about the axes 26 and 28 cause the elements, connected together by the rotational pins 31, to operate as a joint of universal or cross or similar type allowing any movement to be undergone by the mooring chain 9, which by its ends 9*a* and 9*b* is anchored symmetrically to the flat projections 27 of the rotatable sleeve (see FIG. 4) by means of the rings 16. The operations involved in mooring the tanker will now be described.

It should be noted that the fixed structure and the elements connected to it must in all cases be sized to resist the mooring stresses of any loaded tanker subjected to the various sea and wind conditions. In the case of typical berthing, the tanker, approaching under the most suitable prevailing wind, halts in proximity to the berth and being kedged in this position by its own means, or with the aid of a tug, takes the mooring chain 9 and anchors it rigidly to the tanker bow. Mooring is implemented in accordance with the known art as long used in arriving at the berthing point. Having terminated mooring, the tanker is connected to the sea line by the flexible pipeline system, and the loading and/or unloading of the fluid being transferred commences. During the loading and unloading, the tanker remains free to move about its mooring, following without reaction the force of the wind or sea, the tanker hence assuming that orientation which the direction of the wind and possible sea current impose on it. From the aforegoing it is apparent that the method of the present invention has the significant advantage of separating the two functions normally inherent in a berthing point, namely that of mooring the tanker and that of transmitting the fluid to be handled from the tanker to the underwater line 11 or vice versa. In this manner the mooring pull by the tanker directly stresses the anchoring base 1 via the chain 9, without minimally involving the flexible pipelines handling the fluid. The structure of the invention can be implemented in a simple and economical manner.

The mooring chain 9 is fixed to the anchoring base 1 by elements which allow rotation about axes orientated in several directions, said elements advantageously assuming the operational functions of a ball joint. There is therefore no impact danger in the case of collision between the tanker and the surface equipment, and the tanker is free to orientate itself in the best direction according to the prevailing wind and the sea conditions at that moment.

Consequently unmooring caused by the sea conditions is obviated, and the flexible pipelines 10 and 12 are not subjected to any substantial stress so that the well-known problems deriving from possible fracture of these pipelines are avoided. Unmooring is performed in the opposite manner to mooring, and under unloaded conditions the flexible pipeline 10 and the mooring chain 9 are left hanging in the vertical position, parked under the sea surface with their ends connected to known means and probes which enable them to be recovered on board. Although the present invention has been described with reference to determined embodiments, numerous modifications can be made to the constructional forms of the operational elements, in which respect any changes in the relative positions of the elements and any consequent simplifications deriving therefrom are to be considered as falling within the requested protection as constructional modifications included within the general idea.

We claim:

1. A single point mooring method, comprising the steps of:

anchoring a fixed structure to sea bed;

connecting a first member to said fixed structure rotatably around a first axis;

connecting a second member to said first member rotatable around a second axis perpendicular to said first axis;

connecting said tanker mooring line to said second member rotatably; and rotatably connecting to said second member a flexible pipeline for transferring fluid to or from the tanker so as to compensate stress in said tanker mooring line caused by translational and rotational movements of the tanker.

2. A single point mooring method according to claim 1, wherein said second member can move along a spherical surface.

3. A single point mooring method according to claim 1, wherein a flexed position of a portion of said pipeline extending between a joint with a rigid bed pipeline and a joint with a connection portion of a rotating elements is freely assumable, said flexed position substantially depending on a direction of said tanker mooring line.

4. A single point mooring system comprising:

a fixed structure anchored to sea bed;

a toroid shaped device having a center axis and connected to said fixed structure rotatably around said center axis;

a fork shaped element having opposite first and second ends, said first end having two end portions connected to said toroid shaped device swingably around a swing axis perpendicular to said center axis, said second end adapted to be connected to a mooring line for mooring a tanker; and a sleeve rotatably connected to said fork shaped element, said sleeve rotatably supporting a flexible pipeline for transferring fluid to or from the tanker.

5. A single point mooring system comprising:

a fixed structure anchored to sea bed;

a toroid shaped device having a diameter axis and connected to said fixed structure rotatably around said diameter axis;

a fork shaped element having opposite first and second ends, said first end having two end portions connected to said toroid shaped device swingably around a swing axis perpendicular to said diameter axis, said second end adapted to be connected to a mooring line for mooring a tanker; and a sleeve rotatably connected to said fork shaped element, said sleeve rotatably supporting a flexible pipeline for transferring fluid to or from the tanker.

* * * * *